United States Patent [19]

Mon

[11] 4,253,495

[45] Mar. 3, 1981

[54] FLUIDIC ELEMENT WITH SUBSTANTIALLY ZERO NULL OFF-SET

[75] Inventor: George Mon, Silver Spring, Md.

[73] Assignee: The United States of America as represented by the Secretary of the Army, Washington, D.C.

[21] Appl. No.: 930,968

[22] Filed: Aug. 4, 1978

[51] Int. Cl.[3] ..... F15C 5/00

[52] U.S. Cl. ..... 137/833

[58] Field of Search ..... 137/833

[56] References Cited

U.S. PATENT DOCUMENTS

| | | | |
|---|---|---|---|
| 3,467,124 | 9/1969 | Simson | 137/833 X |
| 3,534,755 | 10/1970 | Urbanosky | 137/833 X |
| 3,731,700 | 5/1973 | Cohen | 137/833 |
| 3,942,558 | 3/1976 | Honda et al. | 137/833 X |

OTHER PUBLICATIONS

Phillippi, Michael R., A Study of Fineblanking for the Manufacture of Flueric Laminar Proportional Amplifiers, HDL-TM-77-8, May 1977.

*Primary Examiner*—William R. Cline

*Attorney, Agent, or Firm*—Nathan Edelberg; Robert P. Gibson; Saul Elbaum

[57] ABSTRACT

A fluidic element, such as a laminar proportional amplifier or laminar jet rate sensor, whose null off-set is reduced to substantially zero. A plurality of substantially identical thin laminate plates are stacked between a pair of cover plates. Each of the laminate plates has a passage formed therethrough which is formed by fine blanking that is characterized by formation of a die roll. The die roll has a portion thereof, characterized as a burr, projecting from one side of the plate. A separator plate is positioned between a like number of laminate plates so that the die rolls of each plate on one side of the separator plate face in the opposite direction to that of the die rolls of each of the laminate plates positioned on the other side of the separator plate. The laminate plates and separator plates are all in fluid communication with at least one of the cover plates via aligned supply, control and output conduits.

6 Claims, 8 Drawing Figures

FIG. 1.
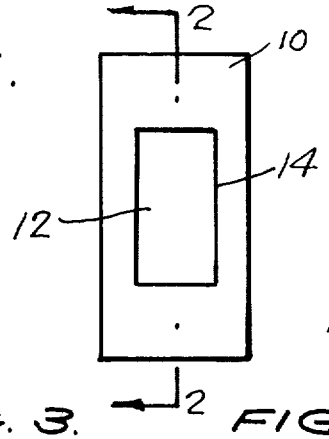
FIG. 2.
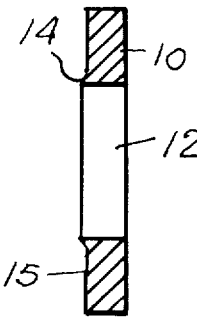
FIG. 3.
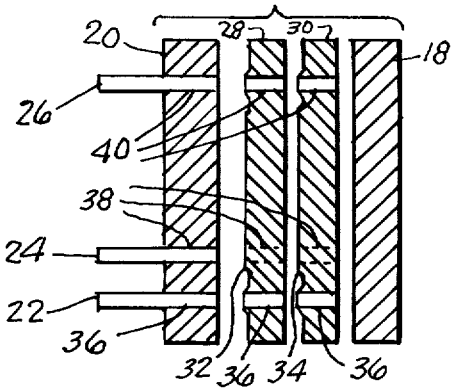
FIG. 4.
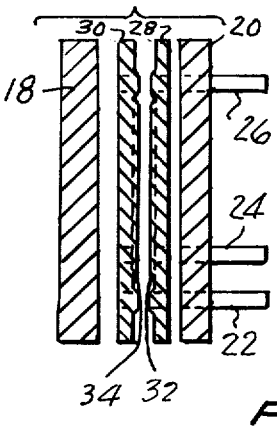
FIG. 5.
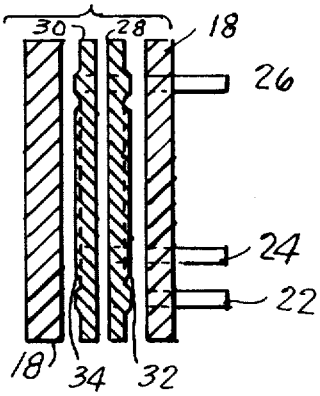
FIG. 6.
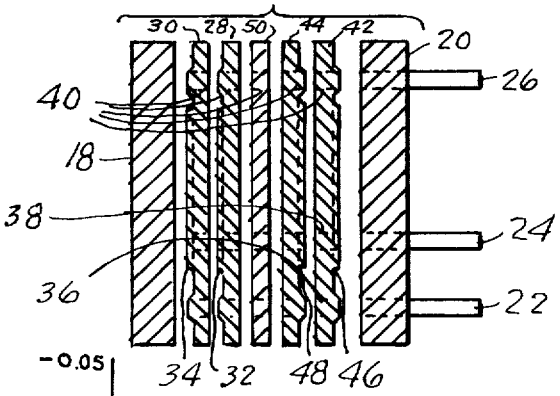
FIG. 7.
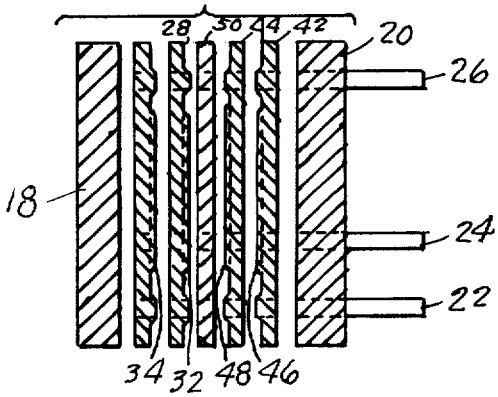
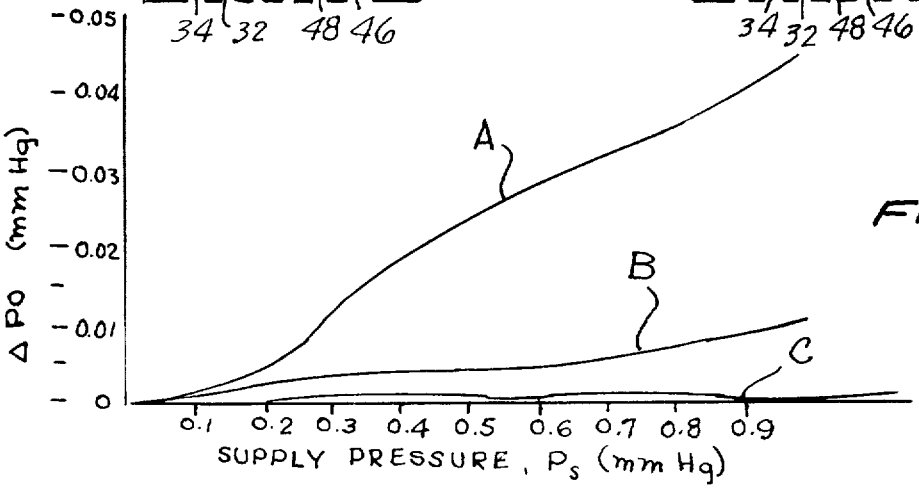
FIG. 8

FLUIDIC ELEMENT WITH SUBSTANTIALLY ZERO NULL OFF-SET

RIGHTS OF THE GOVERNMENT

The invention described herein may be manufactured, used, and licensed by or for the United States Government for governmental purposes without the payment to me of any royalty thereon.

BACKGROUND OF THE INVENTION

1. Field of the Invention

The present invention is related to fluidic elements and, more particularly, is directed towards a fluidic element which consists of a plurality of substantially identical fine blanked laminate plates.

2. Description of the Prior Art

One of the major problems facing a designer of fluidic systems concerns the ever present null off-set due to supply pressure or temperature variations. This problem is present, for example, in fluidic elements known as the laminar proportional amplifier and laminar jet rate sensor. Each of these components, as well as other components, utilize a plurality of extremely thin metal laminate plates which have the appropriate fluid passages formed therein.

The problem of null off-set is caused by geometric imperfections in the plates which inherently result from the manufacturing process. Typical prior art manufacturing processes include machining and metal etching of the individual laminate elements. For these two techniques, it is almost impossible to produce a symmetrical fluidic element, such as a laminar proportional amplifier. Furthermore, the machining and metal etching manufacturing techniques produce geometric imperfections in these elements which are random in nature. Therefore, it is extremely difficult to compensate for null off-set with randomly imperfect elements. As a result, with prior art techniques it is impossible to construct fluidic elements without null off-set over the supply pressure range. While many attempts have been advanced to minimize this problem, unfortunately the problem persists.

A manufacturing technique known as fine blanking has proven helpful in eliminating the random variations in the geometrical imperfections. Thus, even though it is still impossible to produce a perfectly symmetrical element, laminates which are produced by fine blanking from the same set of dies have demonstrated essentially the same mechanical bias. Accordingly, while not eliminating the null off-set problem, at least those elements produced by fine blanking provide a predictable null off-set which can be compensated.

OBJECTS AND SUMMARY OF THE INVENTION

It is therefore a primary object of the present invention to provide a fluidic element which overcomes all of the disadvantages noted above with respect to prior art devices.

Another object of the present invention is to provide a fluidic element which includes means for reducing the null off-set thereof to substantially zero.

A further object of the present invention is to provide a fluidic element formed of a plurality of laminate plates, each formed by fine blanking, which are arranged in such a fashion so that the problem of null off-set is eliminated.

An additional object of the present invention is to provide a fluidic element which includes a plurality of stacked laminate sheets formed by fine blanking which has essentially zero null off-set over the entire range of the operating supply pressure.

The foregoing and other objects are attained in accordance with one aspect of the present invention through the provision of a fluidic element which comprises a first thin laminate plate having a passage formed by fine blanking that is characterized by a die roll extending around the passage formed in the plate, and a second thin laminate plate which is substantially identical to the first plate. A portion of the die roll, characterized as a burr, extends from one side of the plate. Means are positioned between the first and second plates for separating same. The burr of the first plate faces in one direction while the burr of the second plate faces the opposite direction. In this manner, the inherent, repeatable mechanical biases of each laminate plate effectively cancel one another to produce a substantially zero null off-set.

In accordance with other aspects of the present invention, the separating means comprises a thin separating plate, and front and rear cover plates are positioned on the outside of the first and second laminate plates. The front cover plate may include supply, control and outlet conduits extending therethrough for operating the fluidic element. In this case, the first, second and separating plates each have at least three conduits extending therethrough which are respectively in fluid communication with the supply, control and outlet conduits in the front cover plate. In one form of the invention, the burr of the first plate faces the front cover plate while the burr of the second plate faces the rear cover plate. In an alternative embodiment, the burrs of the first and second plate each face the central separating plate.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which:

FIG. 1 is a plan view of a typical fine blanking laminate which is utilized in the preferred embodiment of the present invention;

FIG. 2 is a cross sectional view of the laminate illustrated in FIG. 1 and taken along line 2—2 thereof;

FIG. 3 is an exploded view of a prior art fluidic element utilizing fine blanking laminates;

FIGS. 4 and 5 are exploded views which illustrate fluidic elements which illustrate improved performance over the prior art fluidic element illustrated in FIG. 3;

FIG. 6 is an exploded, side-sectional view of a preferred embodiment of the present invention;

FIG. 7 is an exploded, side-sectional view which illustrates an alternate embodiment of the present invention; and FIG. 8 is a graph helpful in understanding the improvement afforded by virtue of the present invention.

DETAILED DESCRIPTION OF THE PREFERRED EMBODIMENTS

Referring now to the drawings, wherein like reference numerals represent identical or corresponding parts throughout the several views, and more particularly to FIGS. 1 and 2 thereof, there is illustrated front and sectional views, respectively, of a typical laminate plate which forms part of a fluidic element. The laminate plate 10 is typically on the order of five to 10 mils, but is shown greatly exaggerated in thickness for ease in illustration.

The laminate plate 10 is produced by fine blanking which is a very close, precision die processing technique that yields precise, accurate fluidic elements and which is repeatable on the same die from element to element. Fine blanking laminates differ from metal etched or machined laminates in that laminates formed by fine blanking have die comprising burrs 14 formed along the edge of the fluid passage 12 extending through the element 10. For ease in illustration, FIGS. 1 and 2 show a substantially rectangular fluid passage 12, although it is understood that the fluid passage formed by the fine blanking can have substantially any configuration desired for the particular fluidic component, such as may be necessary for the supply nozzle, control nozzle, or the like.

Note that the burr 14 extends about the periphery of the passage 12 formed in the laminate plate 10. Also note that the burr 14 is formed only on one side 15 of the plate 10 and extends in the same direction along which the die which formed the passage 12 moved. For the sake of ease in explanation, the burr 14 of FIG. 2 will be referred to hereinafter as facing to the left, meaning that the die producing passage 12 moved in this instance from the right to the left as viewed in FIG. 2.

FIGS. 3 through 5 illustrate three conventional ways of stacking the fine blanking laminates in a fluidic element, such as a laminar proportional amplifier or a laminar jet rate sensor. Referring first to FIG. 3, there is shown generally a cross-sectional side view, which is exploded, of a laminar proportional amplifier which includes a back cover plate 18 and a front cover plate 20. Front cover plate 20 typically includes a supply channel 22, a control channel 24, and an output channel 26. A pair of laminate sheets formed by fine blanking are indicated by reference numerals 28 and 30 and are positioned between cover plates 18 and 20. Fine blanking sheets 28 and 30 are characterized by the formation of respective burrs 32 and 34 which face in the same direction, to the left as illustrated in FIG. 3. Note that plates 20, 28 and 30 include supply passages 36, control passages 38 and output passages 40 which are in fluid communication with one another and with channels 22, 24 and 26, respectively. Passages 36, 38 and 40 on plates 28 and 30, formed by fine blanking, also comprise burrs as indicated in the drawings.

Referring now to FIG. 8, a graph is shown which illustrates typical performance for a laminar proportional amplifier wherein the vertical axis represents the change in output pressure whereas the horizontal axis represents the supply pressure. The curve indicated by reference letter A shows the null off-set trace of a laminar proportional amplifier constructed in accordance with the embodiment illustrated in FIG. 3. As may be appreciated, for increasing supply pressure, there is substantial null off-set.

FIGS. 4 and 5 differ from the embodiment of FIG. 3. FIG. 4 shows the fine blanking laminates 28 and 30 having their burrs 32 and 34 facing one another, whereas FIG. 5 shows the fine blanking laminates 28 and 30 stacked so that their respective burrs 32 and 34 face in opposite directions respectively adjacent cover plates 20 and 18. Curve B of FIG. 8 shows the performance characteristics of a laminar proportional fluidic amplifier constructed in accordance with the embodiment of FIGS. 4 and 5. While illustrating a substantial improvement over Curve A, the null off-set demonstrated by Curve B (FIGS. 4 and 5) is still too much for most practical applications.

Referring now to FIG. 6, a preferred embodiment of the present invention is illustrated. Reference numerals 28 and 30 still refer to a pair of substantially identical fine blanking laminates having burrs 32 and 34 facing in the same direction, to the left as viewed in FIG. 6. An additional pair of fine blanking laminates 42 and 44 are also provided. Laminates 42 and 44 have respective burrs 46 and 48 which also face in the same direction, to the right as viewed in FIG. 6. Note that the burrs 32 and 34 face the opposite direction that faced by burrs 46 and 48. Positioned between the fine blanking laminate plates 28 and 44 is a separating plate 50 (not fine-blanked). The thickness of plate 50 is on the same order as that of the fine blanking laminate plate 28, 30, 42 and 44. It may be appreciated that laminate plates 28 and 30 may be thought of as forming one half of a laminar proportional amplifier, whereas plates 42 and 44 may be thought of as forming the other half. Separating plate 50 creates a mirror image for the two halves of the amplifier and provides greater isolation so that the respective inherent (but constant) mechanical bias in each amplifier half cancel one another. Accordingly, the plate 50 provides better mechanical cancellation and minimizes interference between the mechanical bias of the two amplifier halves.

The amplifier halves are all in fluid communication with the supply 22, control 24 and output 26 via respective conduits 36, 38 and 40 which extend through all of the plates 28, 30, 42, 44 and 50.

Referring briefly to FIG. 8, Curve C indicates the performance characteristic of the preferred embodiment of the present invention illustrated in FIG. 6. As may be appreciated, Curve C represents a reduction of two orders of magnitude in the null off-set from all prior techniques, to a point where the null off-set is substantially zero over the supply pressure variation.

FIG. 7 indicates an alternative embodiment of the present invention wherein the burrs 32 and 34 of laminate plates 28 and 30 face to the right as viewed in FIG. 7, whereas burrs 46 and 48 of laminate plates 42 and 44 face to the left. The present invention provides that the burrs on all fine-blanking laminates positioned on one side of the separating plate 50 face in the same direction, which direction is opposite to that direction faced by the burrs on the other side of the separating plate. A greater or fewer number of laminates could be provided, as may be necessary for any particular application.

Obviously, numerous modifications and variations of the present invention are possible in light of the above teachings. It is therefore to be understood that within the scope of the appended claims, the invention may be practiced otherwise than as specifically described herein.

I claim as my invention:

1. A fluidic element which comprises:

a first thin laminate plate having supply and outlet conduits; a substantially continuous fluid passage between said supply and outlet conduits formed by fine blanking that is characterized by a die roll comprising a burr extending around said passage on one side of said plate;

a second thin laminate plate substantially indentical to said first plate; and a thin separating plate positioned between said first and second plates for isolating from one another the respective passages of said first and second plates between said supply and outlet conduits thereby forming separate and distinct flow paths;

said burr of said first plate facing in one direction while said burr of said second plate faces in the opposite direction; front and rear cover plates between which said first, second and separating plates are positioned; whereby the null off-set of said fluidic element due to supply pressure and temperature variations is reduced to substantially zero.

2. The fluidic element as set forth in claim 1, wherein said front cover plate includes supply, control and outlet conduits extending therethrough.

3. The fluidic element as set forth in claim 2, wherein said first, second and separating plates each have at least three conduits extending therethrough which are respectively in fluid communication with said supply, control and outlet conduits in said front cover plate.

4. The fluidic element as set forth in claim 1, wherein said burr of said first plate faces said front cover plate and said burr of said second plate faces said rear cover plate.

5. The fluidic element as set forth in claim 1, wherein said burrs of said first and second plates each face said separating plate.

6. The fluidic element as set forth in claim 1, having additional laminate plates and separating plates positioned between the cover plates.

* * * * *